United States Patent [19]

O'Neil et al.

[11] Patent Number: 4,570,793

[45] Date of Patent: Feb. 18, 1986

[54] DESK CONSOLE ELEMENT

[75] Inventors: Robert A. O'Neil, West Chicago; William G. Broman, Chicago; Leon C. Clouser, Lombard, all of Ill.; Adrian T. Dombrowski, Remington, Ind.; Arthur R. Harth, Chicago; Bernhard O. Williams, Elmhurst, both of Ill.

[73] Assignee: McDonald Products Corporation, Buffalo, N.Y.

[21] Appl. No.: 612,432

[22] Filed: May 21, 1984

[51] Int. Cl.[4] ..... B65D 21/02

[52] U.S. Cl. ..... 206/371; D19/84; D19/92; 206/214; 206/224; 211/11; 220/23.4; 312/111

[58] Field of Search ..... D19/20-23, D19/25, 75, 77-79, 84-86, 92; D27/47; 206/1.7, 214, 224, 371, 443, 446, 483, 558, 526; 211/11, 60 R, 69.1, 69.4, 71, 88, 126; 220/4 R, 4 F, 23.2, 23.4, 22.3; 312/107, 108, 111, 140, 237

[56] References Cited

U.S. PATENT DOCUMENTS

| | | | |
|---|---|---|---|
| D. 173,818 | 1/1955 | Rogers . | |
| D. 213,236 | 1/1969 | Zacharia . | |
| D. 260,906 | 9/1981 | Grusing . | |
| D. 262,382 | 12/1981 | Martin . | |
| 3,446,544 | 5/1969 | Serwer | 312/111 |
| 3,552,579 | 1/1971 | Simon et al. | 312/108 |
| 3,599,828 | 8/1971 | Conway et al. | 220/23.4 |
| 4,120,119 | 10/1978 | Engel | 220/4 F |
| 4,227,758 | 10/1980 | Clare | 220/23.4 |
| 4,384,647 | 5/1983 | Schweizer | 220/23.4 |
| 4,385,212 | 5/1983 | Tyler | 312/111 |
| 4,403,700 | 9/1983 | Manlove | 220/20 |
| 4,406,368 | 9/1983 | Hermes | 220/23.4 |
| 4,438,852 | 3/1984 | Evans | D19/75 |

FOREIGN PATENT DOCUMENTS

| | | | |
|---|---|---|---|
| 0411970 | 6/1934 | United Kingdom | 220/23.4 |

*Primary Examiner*—William T. Dixson, Jr.
*Assistant Examiner*—Jimmy G. Foster
*Attorney, Agent, or Firm*—Christel, Bean & Linihan

[57] ABSTRACT

A desk console element includes a receptacle member for holding a desktop item such as a pen and pen base and further includes a one-piece connecting clip for releasably connecting the receptacle member to the receptacle member of a like element. The connecting clip includes a first part and a second part, and the receptacle member includes a pair of elongated tracks for slidably accepting the first clip part and detent-defining means which, with the tracks, cooperate with the first clip part to releasably interlock the clip and the receptacle member. The second clip part is adapted to be releasably interlocked with the receptacle member of the like member as the first clip part is adapted to be releasably interlocked with the receptacle member of its element. The element is well-suited for use in a desk console comprised of an assembly of like elements so that the desk console accomodates the addition of an element to, the removal of an element from, and permits a change in the order of the arrangement of desktop items in the console.

25 Claims, 18 Drawing Figures

Fig. 1.
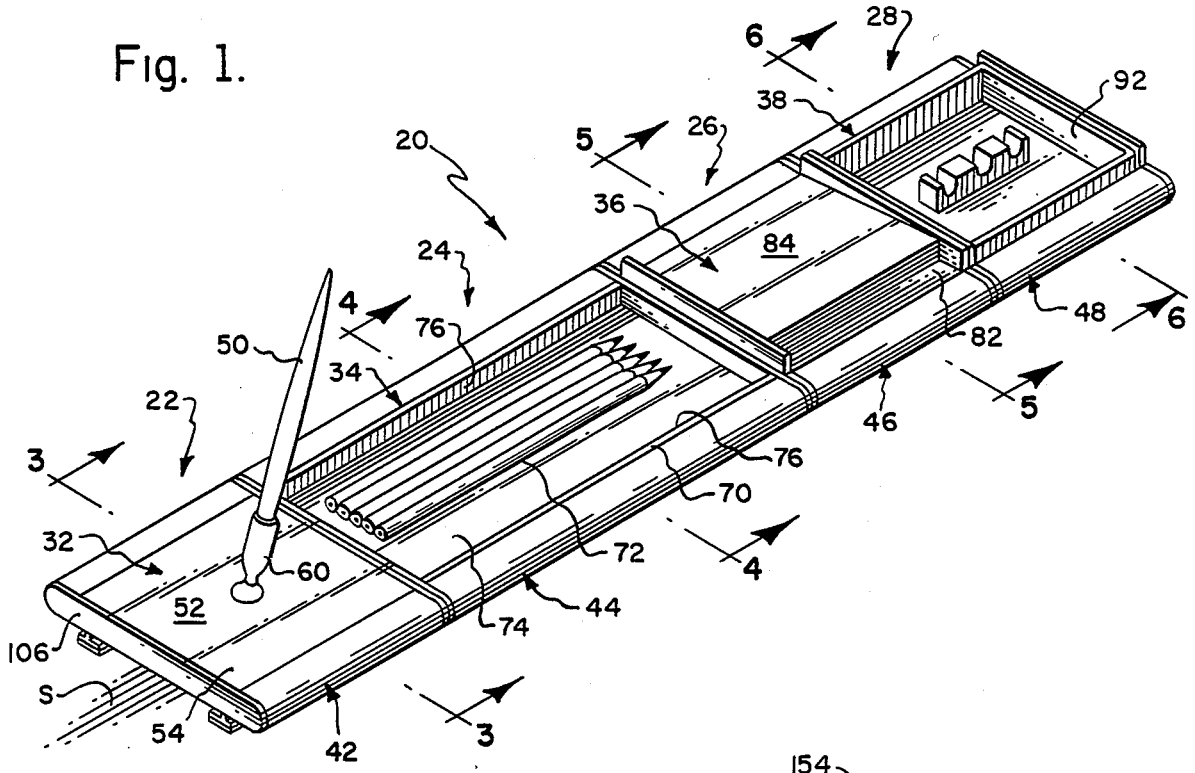
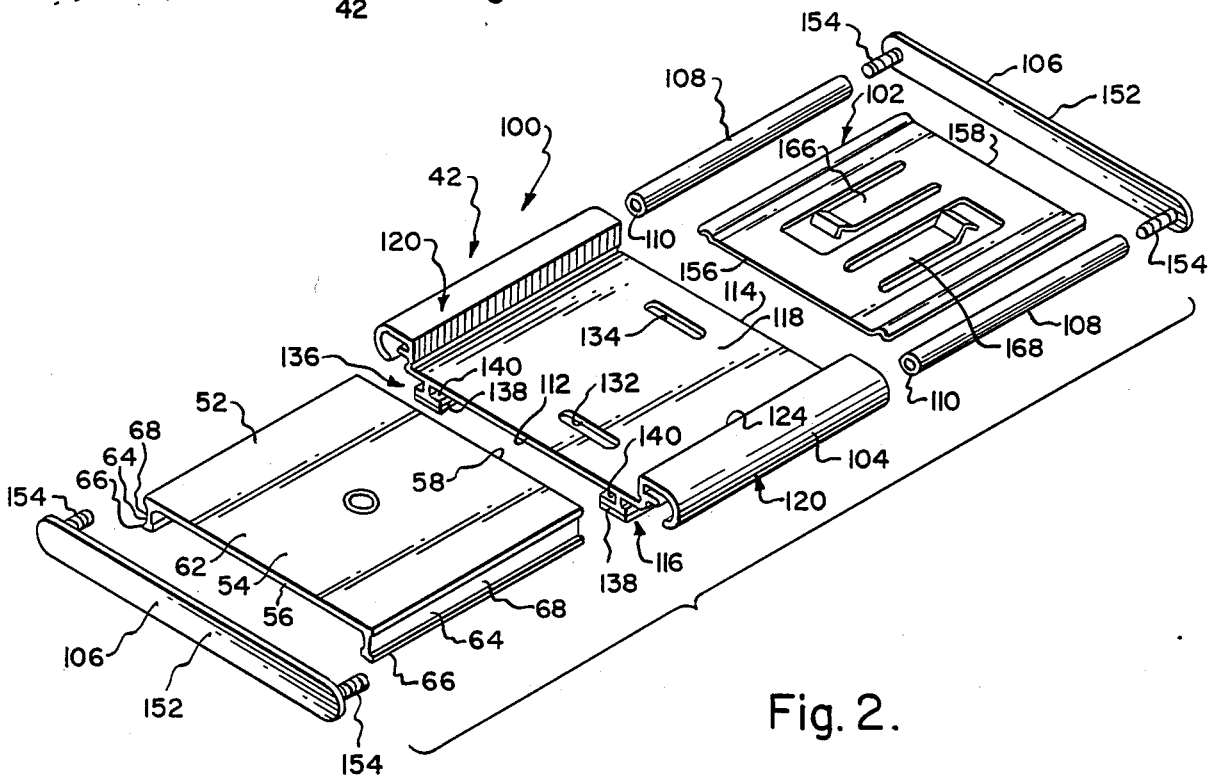
Fig. 2.

DESK CONSOLE ELEMENT

BACKGROUND OF THE INVENTION

This invention relates generally to office accessories and relates more particularly to a desk console, or a desk console system, wherein a plurality of desktop items are held in an orderly arrangement. Such a desk console is commonly positioned upon the surface of an office desk to enhance the appearance of the desk and is generally elongated in shape with its desktop items arranged in a line extending from one of its ends to the other. Desktop items which can be utilized in such a desk console include such items as a pen and a corresponding pen base, a pencil tray, a paper clip tray, a calendar and a corresponding supporting base, an ashtray, a memo pad and a corresponding supporting base, a calculator and a corresponding base, and a clock.

Desk consoles include a plurality of desktop items and a carrier having a plurality of compartments or receptacles in which the desktop items are supported. Conventional console carriers include a preselected number of receptacles for holding a preselected number of desktop items, and each carrier receptacle is of such a shape to closely accept a desktop item of a predetermined size and shape.

Presently, the shapes and sizes of desktop items for use with console carriers are not standard throughout the industry, and it is not uncommon that even from a single supplier, the size of one desktop item, such as a pen base, is not the same as that of another type of item, such as an ashtray. Therefore, the selection of desktop items for a console commonly requires the selection of a console carrier specifically designed to hold the selected desktop items, and the selection of a console carrier commonly requires the selection of desktop items specifically designed to be held by the receptacles of the selected carrier.

A limitation associated with a conventional desk console relates to its inflexibility as to the number of desktop items which it holds. More specifically, a conventional console does not accomodate the addition of a desktop item to the arrangement of items held therein nor does it accomodate the removal of a desktop item from the arrangement of items held therein. Thus, if after a desk console is obtained, a desktop item is desired to be added to the arrangement of desktop items held therein or a desktop item in the console arrangement is desired to be removed therefrom so that the remaining items in the arrangement are orderly displayed, another carrier is required.

Another limitation associated with a conventional desk console relates to its inflexibility in regard to the order of the desktop items arranged therein. More specifically, a conventional console cannot accomodate a rearrangement of its desktop items. Thus, if after a desk console is purchased, the order of desktop items in the arrangement of items is desired to be changed, another carrier is required.

Accordingly, an object of the present invention is to provide a desk console element for holding a single desktop item and which can be connected to a like element for comprising a desk console and which, when connected thereto, can be disconnected therefrom.

Another object of the present invention is to provide such a desk console element which can be connected to and disconnected from a like element with relative ease.

Still another object of the present invention is to provide such a desk console element for use in a desk console which enables such console to accomodate the addition of a desktop item to and the removal of a desktop item from the arrangement of items held in the console.

A further object of the present invention is to provide such a desk console element which, when utilized in a desk console including an assembly of like elements, accomodates a change in the order of desktop items in the console.

A still further object of the present invention is to provide a desk console which accomodates the addition of a desktop item to and the removal of a desktop item from the arrangement of items held therein.

A yet still further object of the present invention is to provide such a desk console wherein the order of desktop items in its arrangement of items can be changed.

SUMMARY OF THE INVENTION

The present invention resides in a desk console element for holding a desktop item and for utilization in an assembly of like elements.

The desk console element is comprised of receptacle means for accepting a desktop item together with connecting means for releasably connecting the receptacle means to receptacle means of a like element.

In another embodiment of this invention, a desk console is comprised of a plurality of elements each including receptacle means for accepting a desktop item together with connecting means for releasably connecting its receptacle means to receptacle means of another element in the console. Such a desk console is not limited to a preselected number of desktop items because an additional element having the conneecting features of those in the console can be attached thereto and an element in the console can be removed therefrom. Furthermore, because each console in the console arrangement can be disconnected from one element therein and reconnected to another element therein, the console accomodates a change in the order of desktop items in the console arrangement.

BRIEF DESCRIPTION OF THE DRAWINGS

FIG. 1 is a perspective view of a desk console in which a plurality of desk console elements in accordance with the present invention is utilized.

FIG. 2 is a perspective view of one of the FIG. 1 console elements and a portion of its corresponding desktop item before assembly.

DETAILED DESCRIPTION OF ILLUSTRATIVE EMBODIMENTS

Figure 3:
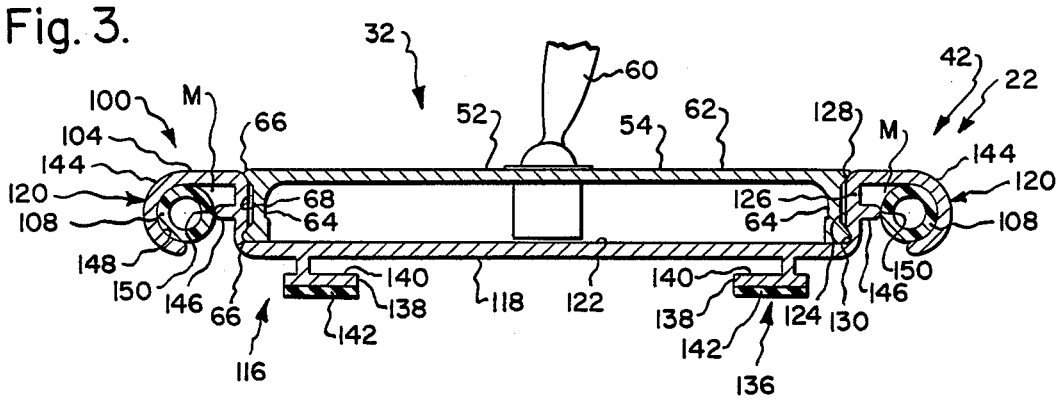
FIG. 3 is a cross-sectional view taken about on line 3—3 of FIG. 1.

Turning now to the drawings in greater detail, there is shown in FIG. 1 a desk console, generally indicated 20 as it would appear when operatively placed upon a horizontal desktop, indicated S, or similar supporting surface. The desk console 20 is somewhat elongated in shape and comprised of an assembly of desk console components 22,24,26 and 28 connected together in a substantially linear arrangement. The component 22 includes a desktop item 32 and a supporting element 42 in which the item 32 is held, the component 24 includes a desktop item 34 and a supporting element 44 in which the item 34 is held, the component 26 includes a desktop item 36 and a supporting element 46 in which the item 36 is held, and the component 28 includes a desktop item 38 and a supporting element 48 in which the item 38 is held. Each console component 22,24,26 or 28 is connected in a manner, explained in greater detail hereinafter, to its adjacent component for the purpose of displaying its desktop item in a side-by-side relationship with the desktop item of the adjacent component.

The desktop item 32 of the FIG. 1 console component 22 includes a pen 50 and a corresponding pen base or insert 52 in which the pen 50 is supported. As shown in FIGS. 2 and 3, the insert 52 includes a U-shaped channel portion 54 having two opposite ends 56 and 58 and is so positioned in the element 42 that its U opens downwardly. The insert 52 further includes a pen receptacle 60 being attached to the channel portion 54 in a manner well known in the art so that the pen 50, when received by the pen receptacle 60 as shown in FIG. 1 is positioned slightly offset to the vertical. The channel portion 54 has a planar portion 62 and two legs 64,64 extending downwardly from the planar portion 62 and between the two channel portion ends 56 and 58. Defined in the outwardly-facing surface of each leg 64 are two ridges 66,66 and a shallow groove 68 having a purpose which will become apparent hereinafter. It has been found that the U-shaped channel portion 54 of the insert 52 can be suitably formed by an extrusion process.

Figure 4:
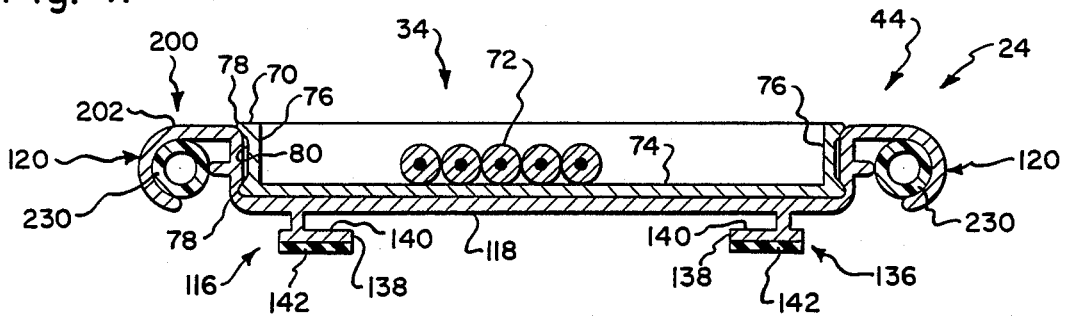
FIG. 4 is a cross-sectional view taken about on line 4—4 of FIG. 1.

The desktop item 34 of the FIG. 1 console component 22 is a pencil tray 70 for holding a plurality of pencils 72. As shown in FIG. 4, the pencil tray 70 is in the form of a U-shaped channel and is so positioned in the element 44 that its U opens upwardly. The tray 70 has a planar portion 74 and two legs 76,76 extending upwardly from the planar portion 74. Each leg 76 or 76 defines in its outwardly-facing surface two ridges 78,78 and a shallow groove 80 as shown. It will be understood that each of the insert 52 of the FIG. 3 desktop item 34 and the pencil tray 70 of the FIG. 4 desktop item 36 is the same in cross-sectional shape as that of the other. Thus, an extrusion having a cross-sectional shape as shown for one of the item 34 and tray 70 can be utilized for the other.

Figure 5:
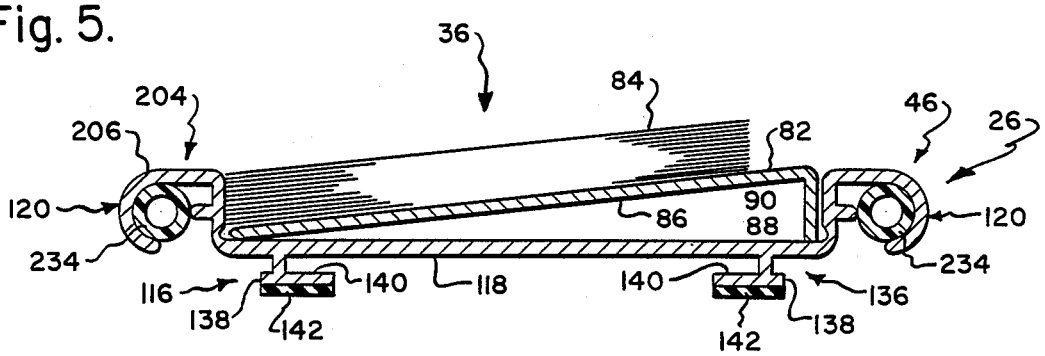
FIG. 5 is a cross-sectional view taken about on line 5—5 of FIG. 1.

The desktop item 36 of the FIG. 1 console component 26 includes a supporting base or insert 82 for holding a memo pad 84. As shown in FIG. 5, the insert 82 is substantially L-shaped in cross-section having a long leg, or planar portion, 86, and a short leg 88. The short leg 88 has an outwardly facing surface 90 which is substantially planar.

Figure 6:
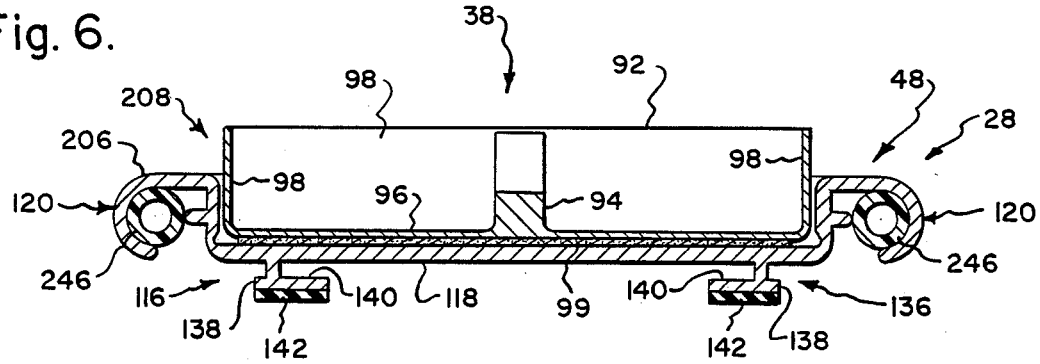
FIG. 6 is a cross-sectional view taken about on line 6—6 of FIG. 1.

The desktop item 38 of the FIG. 1 console component 28 is an ashtray 92. As shown in FIG. 6, the ashtray 92 is substantially cup-shaped with a cigarette-supporting pedestal 94, planar bottom 96 and four planar sides 98,98 (only three shown in FIG. 6). A piece of felt 99 is glued to the underside of ashtray 96.

With reference again to FIG. 2 and in accordance with the present invention, the element 42 of the console component 22 includes a member or means 100 defining a receptacle within which the desktop item 32 is positioned and a connecting clip or means 102 for releasably connecting the receptacle member 100 to the FIG. 1 element 44. The receptacle member 100 includes an extrusion 104, two end caps 106,106 and two flexible tubes 108,108 each defining a through-opening 110. The extrusion 104 and end caps 106,106 are constructed of metal, but can be constructed of any of a number of suitable materials, such as plastic, in accordance with the broader aspects of this invention. The flexible tubes 108,108 are constructed of a resiliently flexible material, such as rubber.

With reference to both FIGS. 2 and 3, the extrusion 104 defines two opposite ends 112 and 114 and includes a base 116 for supporting the element 42 in an operative position upon a substantially horizontal surface. The base 116 includes a plate portion 118, and when the element 42 is operatively positioned as aforesaid, the plate portion 118 is oriented substantially horizontally. The extrusion 104 further includes two side portions 120,120 extending generally upwardly from the base 116 as shown. The plate portion 118 of the base 116 defines an upper planar surface 122, and each side portion 120 or 120 defines an inwardly-facing surface 124. As best shown in FIG. 3, each side surface 124 or 124 defines a central planar portion 126, an upper curved portion 128 and a lower groove 130. Collectively, the surfaces 122,124 and 124 define a receptacle substantially in the form of a U-shaped channel for closely accepting the desktop item 32 placed therein, with the surface 122 providing a channel bottom and the surfaces 124 and 124 providing opposing channel sides. The length of the extrusion 104 as measured between its ends 112 and 114 is substantially the same as the length of the channel portion 54 of the insert 52 measured between its ends 56 and 58.

The desktop item 32 is placed within the extrusion 104 of the receptacle member 100 by initially aligning one end 56 or 58 of the channel portion 54 of the insert 52 with one end 112 or 114 or the extrusion 104 so that the insert 52 can be slidably received within the channel of the extrusion 104. The channel portion 54 is then slidably inserted into the extrusion channel as the ridges 66,66 are guided along the curved portion 128 and groove 130 of each extrusion surface 124 or 124. The channel portion 54 is fully inserted in the extrusion 104 when each of its ends 56 and 58 is positioned even with a corresponding extrusion end 112 or 114. As best shown in FIG. 3, the channel of the extrusion 104 is of such shape to closely accept the channel portion 54 of the insert 52 and to thereby provide a close-fitting relationship therebetween.

Figure 7:
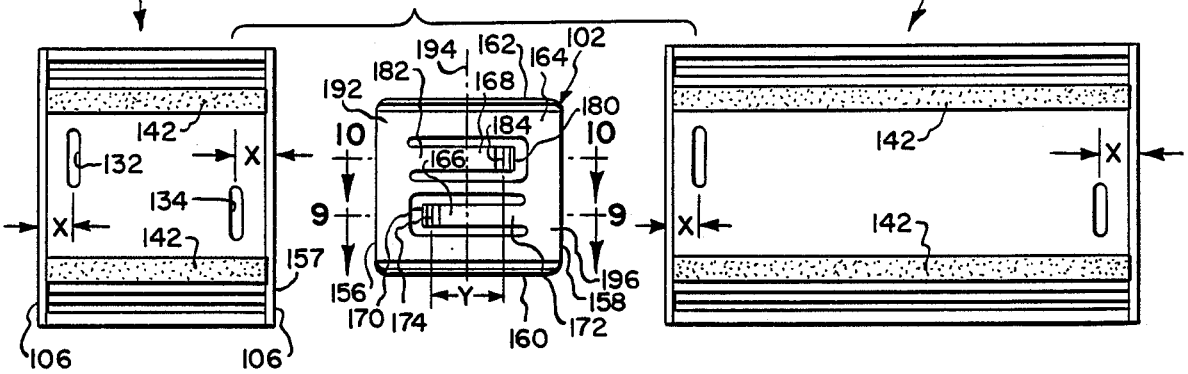
FIG. 7 is a bottom plan view of the receptacle members of two adjacent desk console elements of FIG. 1 and a connecting clip of one of the elements before the receptacle members are connected together.

With reference to FIGS. 2 and 7, the plate portion 118 of the extrusion base 116 includes detent means in the form of two elongated slots 132 and 134. The slots 132 and 134 are so oriented in the plate portion 118 that their longitudinal axes are oriented generally parallel to one another and transverse of the extrusion 104. One slot 132 is positioned near one end 112 of the extrusion 104, and the other slot 134 is positioned near the other end 114 of the extrusion 104.

As shown in FIG. 3, the extrusion base 116 further includes, in addition to the plate portion 118 discussed above, track means 136 comprised of two elongated tracks 138 and 138 which extend downwardly from the plate portion 118 as shown. The longitudinal axes of the tracks 138 and 138 are substantially parallel to one another, and both tracks 138,138 extend between the receptacle member ends 51 and 53. As viewed in FIG. 3, each track 138 or 138 is T-shaped in cross section, is so oriented that the top of its T is directed downwardly and defines with the plate portion 118 of the extrusion base 116 an elongated track groove 140. A strip 142 is relatively soft material such as sponge rubber or leather is attached, as with glue, to the bottom surface of the track 138,138 to provide cushioned supporting feet for the console element 42.

Referring still to FIG. 3, each side portion 120 or 120 of the extrusion 104 includes an arcuate part 144 and a ridge portion 146, as shown. The arcuate part 144 defines an inner curved surface 148, the ridge portion 146 defines an end 150, and between the curved surface 148 and the ridge portion end 150 is defined a space M. The space M is of such shape to snugly accept a corresponding one of the two resiliently flexible tubes 108 or 108 when the tube is fitted therein. Installation of a flexible tube 108 or 108 within a space M is effected by inserting the tube endwise therein until each of the tube ends is positioned even with a corresponding extrusion end 112 or 114.

Each end cap 106 or 106 of FIG. 2 receptacle member 100 includes an elongated planar portion 152 and two cylindrical shanks 154,154. Each shank 154 and 154 extends from one side of the planar portion 154 and is positioned adjacent a corresponding end of the portion 154 as shown in FIG. 2. The shanks 154,154 are of such size and shape and are so positioned relative to one another be snugly received by the through-openings 110,110 of both of the flexible tubes 108 and 108 when fitted therein and to be releasably and snugly held therein by the frictional gripping engagement between the inner surface of the tubes 108,108 and the surface of the shanks 154,154. Thus, with the flexible tubes 108,108 snugly fitted within the spaces M,M defined by the side portions 120,120 of the extrustion 104 and the shanks of the end caps 106,106 snugly fitted within the through-openings 110,110 of the tubes 108,108, the end caps 106,106 are supportedly attached to the extrusion 104 and effectively close the ends of the U-shaped channel defined by the extrusion 104.

As shown in FIG. 7, the installed end caps 106,106 provide ends 155 and 157 of the receptacle member 100, and for a reason which will become apparent hereinafter, the distance between the receptacle member end 155 and the longitudinal axis of the slot 134 and between the receptacle member end 157 and the longitudinal axis of the slot 134 is indicated X. With references to FIGS. 2 and 7, the connecting clip 102 of console element 42 is constructed of a hard resilient material, such as steel, and is of one-piece construction. As viewed in FIG. 7, the clip 102 is substantially rectangular in shape and defines two opposite ends 156 and 158 and two opposite side edges 160 and 162. As viewed in the end view of FIG. 8, the clip 102 is relatively thin in cross-section so as to be slidably received endwise within the track grooves 140,140 of the extrusion base 116. The clip 102 includes a planar portion 164 within which is defined two spring-locking fingers 166 and 168.

Figure 8:
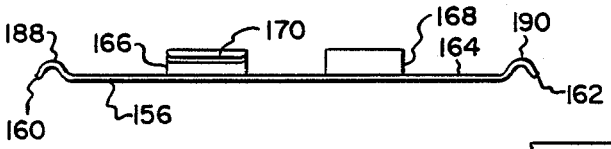
FIG. 8 is an end elevational view of the connecting clip of FIG. 7.
Figure 9:
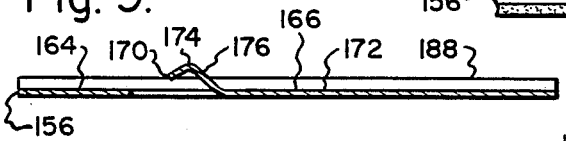
FIG. 9 is a cross-sectional view taken about on line 9—9 of FIG. 7.

With reference to FIGS. 8 and 9, the clip finger 166 is elongated in shape and has a free end 170 which is directed toward the clip end 156 and slightly offset to the plane of the clip planar portion 164. Included along the length of the finger 166 is a finger planar portion 172 and a raised portion 174 positioned adjacent the free end 170. The raised portion 174 is formed so as to provide a curved surface 176 as viewed in FIG. 9 and is of such size and shape to be partially accepted by the slot 134 defined in the receptacle member 100.

Figure 10:
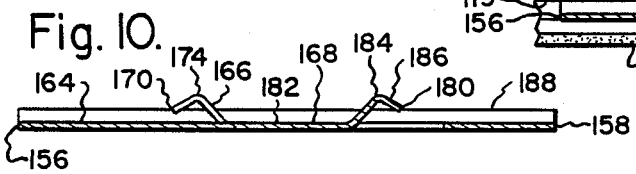
FIG. 10 is a cross-sectional view taken about on line 10—10 of FIG. 7.

With reference to FIGS. 8 and 10, the clip finger 168 is elongated in shape and defines a free end 180 directed toward the clip end 158 and positioned slightly offset to the plane of the clip planar portion 164. Included along the length of the finger 168 is a finger planar portion 182 and a raised portion 184 positioned adjacent the free end 180. The raised portion 184 is formed so as to provide a curved surface 186 as viewed in FIG. 10 and is substantially the same in shape and size as that of the raised portion 174 of the clip finger 166. The distance between the crests of the finger raised portions 172 and 182 as measured along a clip side edge 160 or 162 is indicated Y in FIG. 7, and Y is equal to about twice the distance X.

As shown in FIG. 8, the clip portions adjacent the side edges 160 and 162 of the clip are formed so as to provide a rib 188 or 190 extending therealong. Each rib 188 or 190 is of such shape and size to be slidably accepted by a corresponding track groove 140 or 140 defined in the receptacle member 100 when the clip is slidably inserted therein.

Referring again to FIG. 7, the clip 102 includes a first part, generally indicated 192, extending between its end 156 and a line, indicated 194 and drawn equidistant from the clip ends 156 and 158 so as to bisect the clip 102, for attachment to the receptacle member 100 and to thereby interlock the receptacle member 100 and the clip 102. The first clip part 192 includes a half, or the left half as viewed in FIG. 7, of the clip planar portion 164 and the raised portion 174 of the clip finger 166.

Figure 11:
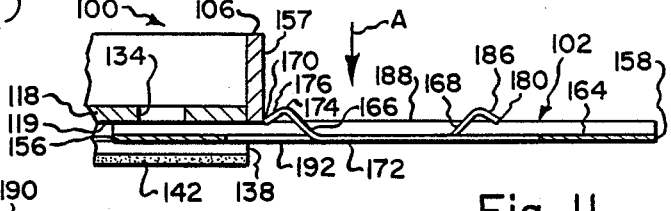
FIG. 11 is a fragmentary elevational view, partly in section, of an element of FIG. 7 illustrating the engagement between a finger of the clip and the end of the element receptacle member at the beginning of clip insertion into the receptacle member.
Figure 12:
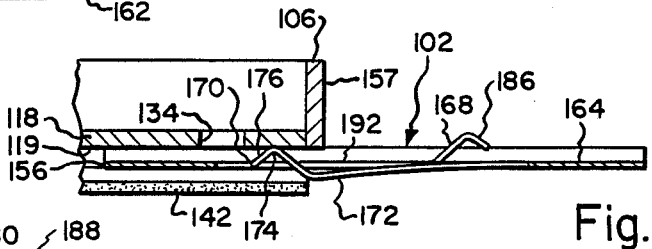
FIG. 12 is a view similar to FIG. 11 illustrating a further state of insertion and the condition of the clip finger before the clip reaches the position at which it interlocks with the receptacle member.
Figure 13:
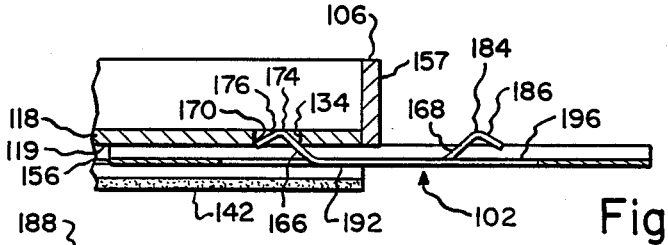
FIG. 13 is a view similar to FIG. 11 illustrating a still further state of insertion and the condition of the clip finger when the clip reaches the position at which it interlocks with the receptacle member.

To attach the clip 102 to the receptacle member 100 and with reference to FIGS. 11-13, the clip end 156 is initially inserted between the receptacle member tracks 138,138 so that the curved surface 176 of the clip finger 166 will face the extrusion plate portion 118 when the clip is inserted therein and so that the clip ribs 188,190 are guided along the track grooves 140,140. As shown in FIG. 11, the free end 170 of the clip finger 166 abuts the receptacle member end 157 when the clip 102 is partially inserted therein. At this point, the clip finger 166 must be pressed so that its free end 170 moves relative to the receptacle member 100 and in the direction of the arrow A until the finger end 170 is positioned below the end cap 106. The clip 102 is then inserted further along the tracks 138,138 as the curved surface 176 of the finger raised portion 174 slides along the lower surface of the extrusion plate portion 118. It will be understood that the resiliency of the clip finger 166 biases its free end 170 from its FIG. 12 condition at which the finger planar portion 172 is slightly inclined to the clip planar portion 164 to its FIG. 11 condition at which the plane of the finger planar portion 172 is parallel to the plane of the clip planar portion 164. Thus, further insertion of the clip 102 along the tracks 138,138 moves the finger raised portion 174 into the receptacle member slot 134 as shown in FIG. 13. With the finger raised portion 174 partially accepted by the slot 134 as shown in FIG. 13, the first clip part 192 is fully accepted by the tracks 138,138 and the clip 102 is in interlocking engagement with the receptacle member 100.

It will be understood from the above that as the clip portion 102 is slidably received by the tracks 138,138 and moved relative thereto, the lower surface, indicated 119, of the extrusion plate portion 118, with the edges of the slot 134, acts as a cam and the curved surface 176 of the finger raised portion 174 acts as a cam follower. Thus, the clip 102 can be slidably moved into and out of interlocking engagement with the receptacle member 100 as the finger raised portion 174 is slidably moved into and out of its FIG. 13 interlocking relationship with the slot 134. It follows from the above that the first clip part 192 and the receptacle member 100 include means for releasably attaching or interlocking the clip 102 and the receptacle member 100.

Referring again to FIG. 7, the clip 102 includes a second part, generally indicated 196, extending between its end 158 and the line 194. The second clip part 196 includes a half, or the right half as viewed in FIG. 7, of the clip planar portion 164 and the raised portion 184 of the clip finger 168. The similarity in shape and size of the second clip part 196 to the first clip part 192 permits the clip 102 to be interlocked with the receptacle member 100 and its slot 134 by inserting either clip end 156 or 158 in the receptacle member end 157 and between the tracks 138,138. If the clip part 192 is wholly inserted in the receptacle member end 157 as discussed above, the slot 134 interlocks with the clip finger 166, and if the clip part 196 is wholly inserted in the receptacle member end 157, the slot 134 interlocks with the clip finger 168. The clip 102 can also be inserted either-end-first in the receptacle member end 155 and between the tracks 138,138 so that one of its fingers 166 and 168 can interlock with the receptacle member slot 132. If the clip part 192 is wholly inserted within the receptacle member end 155, the clip finger 166 interlocks with the slot 132, and if the clip part 196 is wholly inserted within the receptacle member end 155, the clip finger 168 interlocks with the slot 132.

When the first clip part 192 is accepted by the tracks 138,138 and in interlocking engagement with the receptacle member 100 as shown in FIG. 13, the second clip part 196 extends outwardly from the receptacle member 100. As will be explained in greater detail hereinafter, this outwardly-extending second clip part 196 is adapted to releasably attach to the receptacle member of another element in the console 20.

As shown in the interlocking condition of FIG. 13, the curved surface 176 of the finger 166 has a portion which is below the level of the lower surface 110 of the plate base portion. Thus, by inserting the clip 102 further along the tracks 138,138 beyond its FIG. 13 interlocking condition, the finger 166 moves out of interlocking engagement with the receptacle member and slides along the lower surface 119. By inserting the clip 102 until its end 158 is even with the receptacle member end 157, the clip 102 can be thereby stored for shipping or substantially hidden from view as the console element 42 is viewed while the element 42 rests upon a desktop surface.

The remaining console elements 44,46 and 48 of the FIG. 1 console 20 are shown again, in whole or in part, in FIGS. 4–6 and 14–16. With reference to FIG. 4, the element 44 includes a receptacle member or means 200 for supporting the desktop item 34 positioned therein, and the receptacle member 200 includes an extrusion 202 having a cross-sectional shape as shown. With reference to FIG. 5, the element 46 includes a receptacle member or means 204 for supporting the desktop item 36 positioned therein, and the receptacle member 204 includes an extrusion 206 having a cross-sectional shape as shown. With reference to FIG. 6, the element 48 includes a receptacle member or means 208 for supporting the desktop item 38 positioned therein, and the receptacle member 208 includes an extrusion 210 having a cross-sectional shape as shown. It is apparent from FIGS. 4–6 that each of the extrusions 202,206 or 210 is of substantially the same cross-sectional shape as that of the extrusion 104 of FIG. 3 with similarly-shaped parts such as, for example, a base and two side portions, and it is apparent from FIGS. 14–17 that each extrusion 202,206 or 210 differs, if at all, from the extrusion 104 only in length, such length being measured between its two ends. Accordingly, the parts of the extrusions 202,206 and 210 which correspond to parts of the extrusion 104 have been given the same reference numerals.

Figure 15:
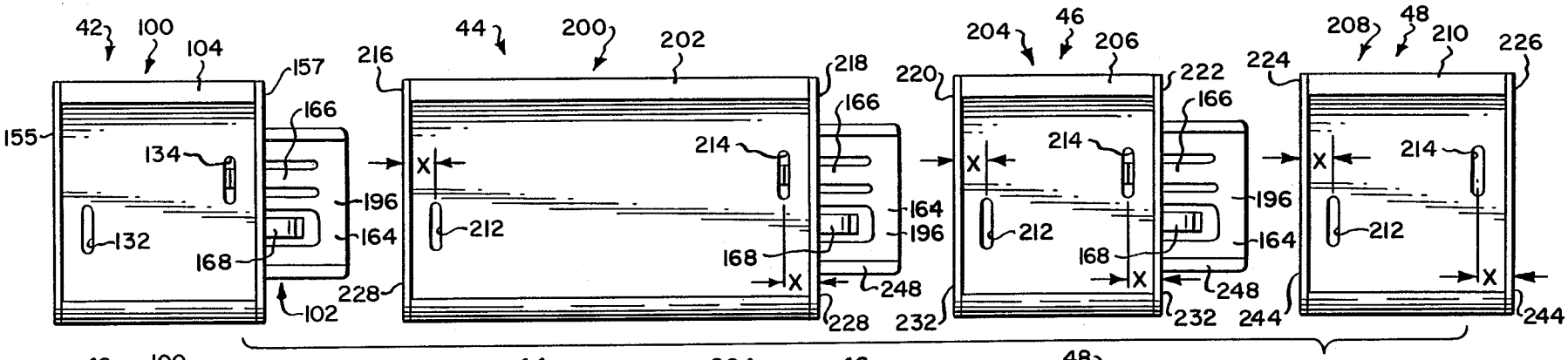
FIG. 15 is a view similar to FIG. 14 showing the elements before being connected.
Figure 14:
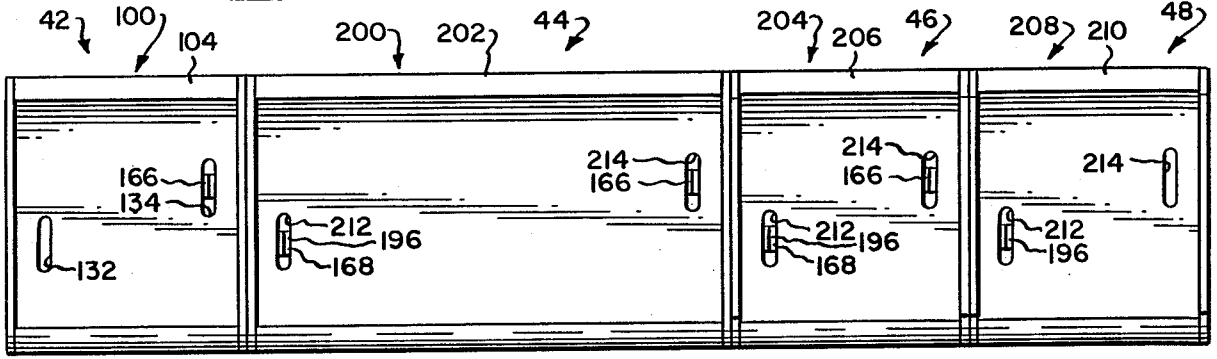
FIG. 14 is a top plan view of the desk console of FIG. 1 shown without its desktop items.

As best shown in FIGS. 14 and 15, each extrusion 202,206 or 210 defines two elongated slots 212,214 so oriented in their corresponding extrusion that their longitudinal axes are oriented generally parallel one another and transverse of their extrusion. The receptacle member 200 defines two ends 216,218 and its slot 212 is positioned near its end 216 and its other slot 214 is positioned near its other end 218. The receptacle member 204 defines two ends 220,222, and its slot 212 is positioned near its end 220 and its other slot 214 is positioned near its other end 222. The receptacle member 208 defines two ends 224,226, and its slot 212 is positioned near its end 224 and its other slot 216 is positioned near its other end 226. As shown in FIG. 15, the longitudinal axes of each slot 214 or 216 is located a distance X from its nearest receptacle end.

With reference to FIGS. 4 and 15, the receptacle member 200 includes two end caps 228,228 and two flexible tubes 230, 230. Each of the end caps 228 or 228 is of the same shape and size as that of an end cap 106 of the receptacle member 100, and each tube 230 or 230 is snugly fitted within a corresponding side portion of the receptacle member extrusion 202. Like the end cap 106, the end caps 228,228 each includes two shanks (not shown) adapted to be snugly accepted within the through-opening of the tubes 230,230 so that when the shanks are received thereby, the end caps 228,228 are supportedly attached to the receptacle member extrusion 202.

Figure 17:
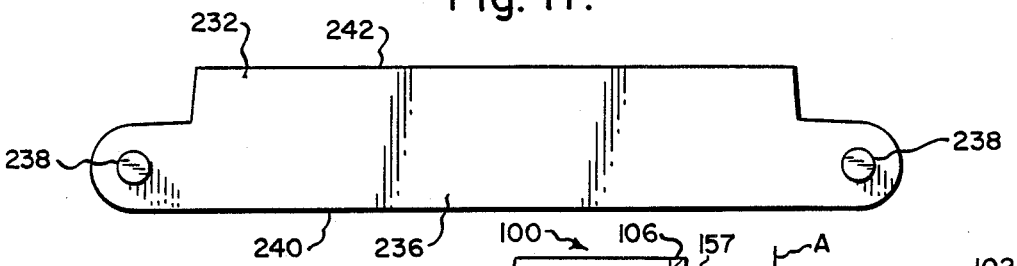
FIG. 17 is an end elevational view of an end cap shown in FIG. 1.

In order that the pencil tray 70 is supportedly held by the console element 44 as shown in FIG. 1, the tray 70 must be positioned within the receptacle member extrusion 202 by slidably inserting the tray 70 endwise into its U-shaped channel so that its ridges 78,78 slidably move along the curved surface 128 and groove 130 of the extrusion 202. It will be understood that the tray 70 is positioned within the extrusion 202 before one of the end caps 228,228 is attached thereto. With reference to FIGS. 5, 15 and 17, the receptacle member 204 includes two end caps 232,232 and two flexible tubes 234,234. Each tube 234 or 234 is snugly fitted within a corresponding side portion of the receptacle member extrusion 206 as shown in FIG. 15. As shown in FIG. 17, each cap 232 or 232 includes an elongated planar portion 236 and two cylindrical shanks 238,238. The planar portion 236 defines a lower edge 240 which is substantially linear and an upper edge 242 having a raised central portion, as shown. The two cylindrical shanks 238,238 are of such size and shape and are so positioned relative to one another to be snugly received by the through-openings of both of the flexible tubes 234,234 when the shanks 238,238 are fitted therein. Thus, with the shanks 238,238 snugly fitted within the through-openings of tubes 234,234, the end caps 234,234 are supportedly attached to the extrusion 206 and effectively close the ends of the U-shaped channel defined thereby.

With reference to FIGS. 6 and 15, the receptacle member 208 includes two end caps 244,244 and two flexible tubes 246, 246. Each of the end caps 244 or 244 is of the same shape and size as that of the FIG. 17 end cap 232, and each tube 246 or 246 is snugly fitted within a corresponding side portion of the receptacle member extrusion 210 as shown in FIG. 6. Like the end cap 232, the end caps 244,244 each includes two shanks (not shown) adapted to be snugly accepted within the through-opening of the tubes 246,246 so that when the shanks are received thereby, the end caps 244,244 are supportedly attached to the receptacle member extrusion 210.

To place the memo pad insert 82 of the FIG. 1 console component 26 within the receptacle member 204, or to place the ashtray 92 of the FIG. 1 console component 28 within the receptacle member 208, the insert 82 and ashtray 50 are each simply dropped along a vertical path into its corresponding receptacle member.

Figure 16:
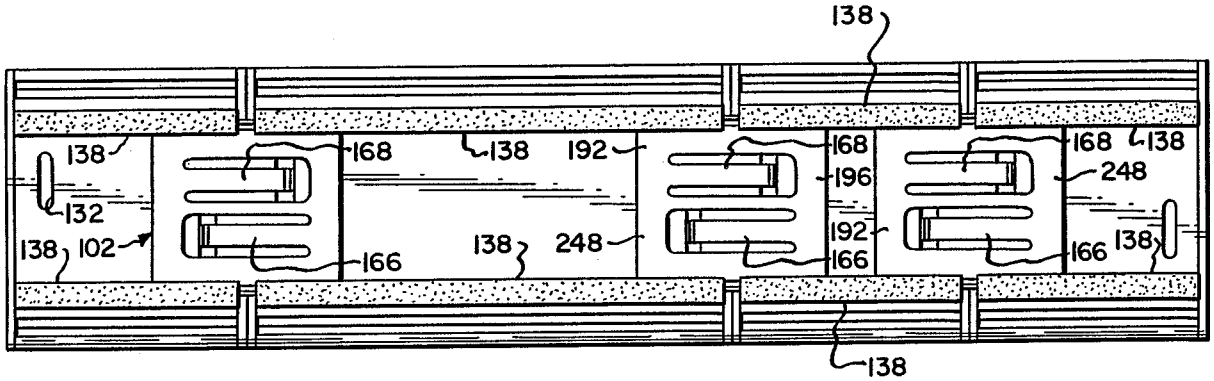
FIG. 16 is a bottom plan view of the desk console of FIG. 1.

As shown in FIG. 16, each console element 44 or 46 includes a connecting clip 248 having a first part 192 which, as shown in FIG. 16, is releasably interlocked with its corresponding receptacle member and a second part 196 which is releasably interlocked with the receptacle member of one of its adjacent elements. The element 48 includes a connecting clip, but since it is not needed for attachment of the element receptacle member 208 to another receptacle member, it is not shown.

Each connecting clip 248 or 248 is substantially the same in size and shape as that of the connecting clip 104 of the console element 42, and each clip 248 can be inserted endwise into an end 218 or 222 of the receptacle member 200 or 204, respectively, so that one of its fingers interlocks with the elongated slot 214 defined therein. Each clip 248 or 248 is interlocked with its receptacle member 200 or 204 in the same manner as the clip 104 is interlocked with its corresponding receptacle member 100 and, accordingly, the discussion above relating to the attachment of the clip 102 to the receptacle member 100 and as illustrated in FIGS. 11–13 applies here as well.

Figure 18:
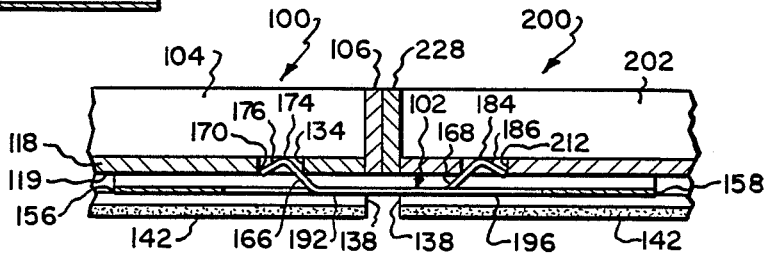
FIG. 18 is a fragmentary elevational view, partly in section, of the receptacle members and clip of FIG. 7 illustrating the interlocking relationship between the clip and receptacle members when the receptacle members are connected together.

With the first part 192 of each connecting clip 102,248 or 248 being releasably interlocked with its corresponding receptacle member 100,200 or 204, its second part 196 extends outwardly as shown in FIGS. 13 or 15 from its receptacle member for attachment to the receptacle member of its adjacent element. As introduced above with regard to clip 102, this second or outwardly-extending clip part 196 includes one-half of the clip planar portion 164 and a raised portion of the clip finger 168. Similar steps are followed in connecting a second clip part 196 to the receptacle member of its adjacent element as were followed in connecting the first clip part 192 to the receptacle member 100 as illustrated in FIGS. 11-13. Such steps include the endwise insertion of the second clip part 196 in a receptacle member end 216,220 or 224 and between the receptacle member tracks 138,138 and moving the clip finger 168 so that its fee end clears the receptacle member end cap 228 or 232 when inserted therebetween. The second clip part 196 is wholly inserted in the end of its adjacent receptacle member when its finger 168 interlocks with the receptacle member slot 212 as shown in FIGS. 14,16 and 18. It will be understood from the above that when a clip is in interlocking engagement with two adjacent receptacle members, end caps of the adjacent receptacle members are in abutting relationship with one another.

Adjacent elements are thus connected together by the cooperation between a clip and two corresponding receptacle member slots in which the clip fingers are interlocked. A clip can be removed from its interlocking condition with a receptacle by moving the clip relative to the receptacle in a direction opposite the direction in which the clip was inserted. During such relative movement, the raised portion of the interlocked clip finger moves out of its corresponding receptacle member slot in a camming action and slides along and relative to the receptacle base plate portion. Thus, adjacent elements in the console 20 can be readily disconnected from one another by simply pulling the elements apart.

Because of the structural similarities between the clips 102,248,248 and between the bases 116,116,116 and 116 of the receptacle members 100,200,204 and 208, respectively, an element in the console 20 can be readily disconnected from its adjacent element and reconnected to another element in the console 20. Such a feature is advantageous in that the order of desktop items in the console arrangement of items can be readily changed.

Another advantage of the interchangeability of elements of this invention in a console relates to the inventory requirements of a manufacturer. A manufacturer who is required to stock conventional desk console carries to accommodate any of several ordered arrangements of desktop items is not required to do so with the elements of this invention because the elements can be connected together in any desired order. Thus, inventory problems which a desk console manufacturer may encounter with conventional desk console carriers are obviated with the elements of this invention.

It follows from the above description that the intended objects of this invention are accomplished. The elements of this invention can be easily attached or detached from one another so as to permit the addition of elements to or the removal of elements from a desk console utilizing elements of this invention. The fact that an element can be easily removed from an assembly of elements is appreciated when one desktop item, such as a calculator, is needed at a jobsite away from the site, such as a desk, at which the element assembly is located.

While the present invention has been described in several illustrative embodiments, it will be understood that still further modifications and substitutions can be had without departing from the spirit of the invention. For example, although each receptacle member 100,200,204 and 208 has been described as a unit comprised of several parts, a receptacle member in accordance with this invention can be formed or molded as a one-piece unit. Furthermore, although the receptacle members 100,200,204 and 208 have been described as supporting desktop items placed therein, a receptacle member in accordance with this invention can be designed so as to support a desktop item positioned upon its surface. Accordingly, the present invention has been described in the illustrative embodiments by way of illustration rather than limitation.

We claim:

1. A desk console element for holding a desktop item and suitable for use in an assembly of like elements, said element comprising:

means defining a receptacle for accepting a desktop item and including a member having two opposite ends and defining a substantially planar camming surface extending between said opposite member ends, said camming surface including a detent, said member including two parallel tracks extending between said member ends and associated with said camming surface so that said tracks extend along said camming surface and said detent is positioned generally between said two tracks; together with a substantially planar clip for releasably connecting said receptacle means to receptacle means of a like element and having two ends, two marginal portions defining two opposite side edges extending between said clip ends and two finger portions positioned generally between said marginal portions, one end of said clip being slidably receivable by said member as said side edges are guided between said tracks, one of said finger portions including a cam-follower surface for sliding relative to and across said camming surface and into and out of interlocking relationship with said detent when said one clip end is slidably received by said member, said tracks maintaining said side edges generally within the plane of said clip as said clip is moved along said tracks, said cam-follower surface adapted to move relative to the plane of said clip when moved into and out of interlocking relationship with said detent and the other finger portion including means extending outwardly from one end of said member when said clip is operatively interlocked with said receptacle means for releasably interlocking said clip and the like element.

2. A desk console element as defined in claim 1 wherein said detent is an opening defined in the plane of said camming surface and said cam-follower surface is of such shape and size to be at least partially received by said opening when said one finger portion is in interlocking relationship therewith.

3. A desk console element as defined in claim 2 wherein said clip is resilient and said cam-follower surface includes a curved portion which is slightly offset to one side of the plane of said clip when said clip is in an undeformed condition and adapted to act between said detent and said tracks to releasably interlock said clip and said receptacle means.

4. A desk console element as defined in claim 1 wherein said one finger portion, when said one clip end is slidably received by said tracks, is movable between a first position at which said one finger portion is out of interlocking relationship with said detent and a second position at which said one finger portion is in interlocking relationship with said detent, and said clip includes biasing means for biasing said one finger portion from said first position to said second position so that as said cam-follower surface is slidably moved across said detent, said one finger portion moves into and out of interlocking relationship with said detent.

5. A desk console element as defined in claim 4 wherein said clip is a one-piece unit constructed of a resilient material and said means for biasing is provided by the resiliency of said clip material.

6. A desk console element as defined in claim 1 wherein said clip ends and first and second finger portions are so structurally similar to one another that said member is cooperable with said second finger portion when the other end of said clip is slidably received by said member to releasably interlock said clip and said receptacle means.

7. A desk console element as defined in claim 1 wherein the like element is a first like element, said detent is a first detent and said camming surface includes a second detent positioned generally between said two tracks for cooperating with a clip of a second like element to thereby releasably connect said receptacle means to the clip of the second like element.

8. A desk console element as defined in claim 7 wherein said two tracks slidably accept one end of the clip of the second like element and said second detent cooperates with the clip of the second like element so that when the is slidably received by said tracks, the second like element clip is slidably movable relative to said tracks and into and out of interlocking relationship with said second detent.

9. A desk console element as defined in claim 1 wherein said clip is of one-piece construction, said first finger portion is associated with one end of said clip for releasably interlocking said clip to said receptacle means and said second finger portion is associated wirh the other end of said clip for releasably interlocking said clip to receptacle means of a like element so that by releasably interlocking said one clip end to said receptacle means and by releasably interlocking said other clip end to the receptacle means of the like element, said element and the like element are releasably interlocked with one another.

10. A desk console element as defined in claim 1 wherein said member defines a U-shaped channel, said channel having two ends, and said receptacle means includes two end caps supportedly attached to said member for effectively closing said ends of said U-shaped channel so that the receptacle of said receptacle means is collectively defined by said channel and said end caps.

11. A desk console element as defined in claim 10 wherein said member includes a base for operatively supporting a desktop item upon a substantially horizontal surface.

12. A desk console element as defined in claim 11 wherein said member is an extrusion.

13. A desk console element as defined in claim 10 wherein said member includes a base for defining the bottom of said channel and two side portions for defining two opposing sides of said channel, and said end caps are attached to said side portions.

14. A desk console element as defined in claim 13 wherein said receptacle means further includes two flexible tubes, each of said tubes defining a through-opening between its ends and being snugly fitted within a corresponding side portion, and each of said end caps including two shank portions, said two shank portions of each end cap being snugly fitted within the through-openings of said tubes.

15. A desk console comprising:

a first means defining a receptacle and including a first member having two opposite ends and defining a substantially planar first camming surface extending between said opposite member ends, said first camming surface defining a first detent, said first member including a first two parallel tracks extending between said opposite member ends and associated with said first camming surface so that said first tracks extend along said first camming surface and said first detent is positioned generally between said first two tracks;

a first desktop item being supportedly received by the receptacle of said first receptacle means;

a second means defining a receptacle and including a second member having two ends and defining a substantially planar second camming surface extending between said second member ends, said second camming surface defining a second detent, said second member including a second two parallel tracks extending between said opposite member ends and associated with said second camming surface so that said second tracks extend along said second camming surface and said second detent is positioned generally between said second two tracks;

a second desktop item being supportedly received by the receptacle of said second receptacle means; and a substantially planar clip releasably connecting said first and second receptacle means to one another and having two ends, two marginal positions defining two opposite side edges extending between said clip ends and two finger portions positioned generally between said two marginal portions, one end of said clip being slidably received by said first member with said side edges being positioned between said first two tracks and the other end of said clip being slidably received by said second member with a of said side edges being positioned between said second two tracks, each of said finger portions including a cam-follower surface positionable in interlocking relationship with a corresponding one of said first and second detents to releasably connect said first and second receptacle means to one another, each of said cam-follower surfaces slidably engaging a corresponding camming surface when said clip is slidably moved relative to and along said tracks so that said cam-follower surfaces are guided into and out of interlocking relationship with said detents as said clip edges are guided along a corresponding one of said first and second trucks, each of said first and second tracks maintaining said side edges generally within the plane of said clip as said clip is moved therealong and each of said cam-follower surfaces adapted to move relative to the plane of said clip when moved into and out of interlocking relationship with the corresponding detent.

16. A desk console as defined in claim 15 wherein each of said first and second camming surfaces defines another detent positioned generally between its corresponding tracks, said clip is a first clip and said console further comprises:

a third means defining a receptacle and including a third member having two opposite ends and defining a substantially planar third camming surface extending between said third member ends, said third camming surface defining a pair of detents, said third member including a third two parallel tracks extending between said third member ends and associated with said third camming surface so that said third tracks extend along said third camming surface and said pair of detents is positioned generally between said third two tracks; a third desktop item being supportedly received by the receptacle of said third receptacle means; and a second substantially planar clip releasably connecting said second and third receptacle means to one another and having two ends, two marginal portions defining two opposite side edges extending between said second clip ends and two finger portions positioned generally between said two marginal portions of said second clip, one end of said second clip being slidably received by said second member with said second clip side edges being positioned between said second tracks and the other end of said second clip being slidably received by said third member with said second clip side edges being positioned between said third two tracks, one of said second clip finger portions including a cam-follower surface cooperating with said another detent of said second camming surface to releasably connect said second clip to said second receptacle means, the other of said second clip finger portions including a cam-follower surface cooperating with said one of said pair of detents of said third camming surface to releasably connect said second clip to said third receptacle means, said members of said receptacle means and said clips being so structurally compatible that the clips can be disconnected from the corresponding receptacle means and reconnected thereto with the order of desktop items in the console arrangement of items being changed.

17. A desk console as defined in claim 15 wherein said detents are slots in said camming surface and each of said cam-follower surfaces are of such shape and size to be at least partially received by a corresponding detent when in interlocking relationship therewith.

18. A desk console as defined in claim 17 wherein said clip is resilient and each of said cam-follower surfaces includes a curved portion which is slightly offset to one side of the plane of said clip when said clip is an undeformed condition and adapted to act between the corresponding detent and the corresponding one of said first and second tracks to releasably interlock said clip to each of said receptacle means.

19. A desk console as defined in claim 18 wherein each of said finger portions is movable between a first position at which it is in interlocking relationship with a corresponding one of said slots and a second position at which it is out of interlocking relationship with the corresponding slot, and said clip includes biasing means for biasing each of said finger portions from its said first position to its said second position so that as a said cam-follower surface is moved across a slot, the corresponding finger portion moves into and out of interlocking relationship with the slot.

20. A desk console as defined in claim 19 wherein said clip is a one-piece unit constructed of a resilient material and said means for biasing is provided by the resiliency of said clip material.

21. A desk console as defined in claim 15 wherein each of said receptacle means includes channel means defining a U-shaped channel, said channel having two ends, and two end caps supportedly attached to said channel means for r effectively closing said ends of said U-shaped channel so that the receptacle of each of said receptacle means is collectively defined by its corresponding channel and end caps.

22. A desk console as defined in claim 21 wherein each channel means includes a base for operatively supporting a corresponding desktop item upon a substantially horizontal surface.

23. A desk console as defined in claim 21 wherein each channel means is an extrusion.

24. A desk console element for holding a desktop item and suitable for use in an assembly of the like elements, said element comprising:

means defining a receptacle for accepting a desktop item, said receptacle means including a member defining a U-shaped channel, two end caps, and two flexible tubes, said channel having two ends, said member including a base for defining the bottom of said channel and two side portions for defining opposite sides of said channel, each of said flexible tubes defining a through-opening between its ends and being snugly fitted within a corresponding side portion, each of said end caps including two shank portions, said two shank portions of each end cap being snugly fitted within the through-openings of said tubes to supportedly attach said two end caps to said side portions of said member and to effectively close said ends of said U-shaped channel so that the receptacle of said receptacle means is collectively defined by said channel and said end caps; together with means for releasably connecting said receptacle means to receptacle means of a like element.

25. A desk console element as defined in claim 1 wherein said clip is resilient and is adapted to releasably interlock with said member when said cam-follower surface of said one finger portion is positioned in interlocking relationship with said detent as the resiliency of said clip biases said cam-follower surface in one direction against said camming surface and biases said clip marginal portions in the direction opposite said one direction against said tracks so that said clip is retained in interlocking position with said member by the frictional gripping engagement between said finger portion and said camming surface and between said marginal and said tracks.

* * * * *

UNITED STATES PATENT AND TRADEMARK OFFICE

CERTIFICATE OF CORRECTION

PATENT NO. : 4,570,793

DATED : February 18, 1986

INVENTOR(S) : Robert A. O'Neil et al

It is certified that error appears in the above-identified patent and that said Letters Patent are hereby corrected as shown below:

In claim 8, line 5, before "is" insert
--second like element clip--.

In claim 21, line 5, omit "r".

Signed and Sealed this

*Twelfth* Day of *August 1986*

[SEAL]

*Attest:*

DONALD J. QUIGG

*Attesting Officer*

*Commissioner of Patents and Trademarks*